US005528105A

United States Patent [19]

Brinn et al.

[11] Patent Number: 5,528,105

[45] Date of Patent: Jun. 18, 1996

[54] COPPER-STEEL COMPOSITE LEAD WIRE AND USE IN INCANDESCENT FILAMENT ELECTRIC LAMPS

[75] Inventors: Walter K. Brinn, Shaker Heights; Charles W. Cox, Willoughby; Stephan Rungwerth, Aurora; Milan R. Vukcevich, University Heights, all of Ohio

[73] Assignee: General Electric Company, Schenectady, N.Y.

[21] Appl. No.: 276,014

[22] Filed: Jul. 15, 1994

[51] Int. Cl.[6] ..... H01J 5/50

[52] U.S. Cl. ..... 313/518; 313/331; 313/332

[58] Field of Search ..... 313/331, 332, 313/578

[56] References Cited

U.S. PATENT DOCUMENTS

| | | | |
|---|---|---|---|
| 1,547,394 | 7/1925 | Hoyt . | |
| 3,366,826 | 1/1968 | Rainone et al. . | |
| 3,573,534 | 10/1968 | Leighton . | |
| 3,636,398 | 1/1972 | Boyce . | |
| 4,071,658 | 1/1978 | Phillips et al. . | |
| 4,131,819 | 12/1978 | Graves . | |
| 4,138,623 | 2/1979 | McMillan . | |
| 4,144,629 | 3/1979 | Phillips et al. . | |
| 4,208,603 | 6/1980 | Graves et al. . | |
| 4,221,989 | 9/1980 | Van Lieshout . | |
| 4,324,998 | 4/1982 | Gilmore et al. . | |
| 4,415,830 | 11/1983 | Pugh et al. . | |
| 4,426,598 | 1/1984 | Whitman . | |
| 4,441,050 | 4/1984 | Steeger et al. . | |
| 4,443,738 | 4/1984 | Roy | 313/332 |
| 4,462,845 | 7/1984 | Klar et al. | 148/13.2 |
| 4,556,822 | 12/1985 | Lohrey et al. . | |

*Primary Examiner*—Sandra L. O'Shea
*Assistant Examiner*—Vip Patel
*Attorney, Agent, or Firm*—Stanley C. Corwin; George E. Hawranko

[57] ABSTRACT

The subject invention relates to a copper-steel composite wire suitable for use as inner lead wires in lamp applications. The subject copper-steel composite wire comprises a steel core having a thick copper cladding on the outside thereof such that the composite lead wire exhibits at least 30% IACS electrical conductivity. The application further relates to the use of the subject composite wire in incandescent lamp applications.

10 Claims, 2 Drawing Sheets

COPPER-STEEL COMPOSITE LEAD WIRE AND USE IN INCANDESCENT FILAMENT ELECTRIC LAMPS

BACKGROUND OF THE INVENTION

This invention relates to electric lamps and, in particular, to an improved composite lead wire for use in electric lamps.

In the prior art, copper and various copper alloys have been used as lead wire material in electric lamps. A recurring problem has been the weakening or annealing of the inner portion of the lead during glass forming operations.

In an effort to forego the use of tie wires and the related manufacturing necessities, dispersion strengthened copper lead wires (DSC) have been used. U.S. Pat. No. 4,138,623 teaches the use of DSC wire, normally a "Glidcop" AL-20 or its equivalent containing 0.20% aluminum oxide calculated as the metal equivalent, with a thin copper plating or sheath generally measuring a fraction of a millimeter in thickness, surrounding an inner core of internally oxidized dispersion strengthened copper. The DSC wire may further be nickel plated to reduce the release of contaminants from the underlying copper. This technology afforded manufacturers an opportunity to eliminate the use of the tie wires to support copper or copper alloy lead wires.

In U.S. Pat. No. 4,208,603, it is taught that if the copper plating or sheath is removed from DSC wire, and the nickel is plated directly onto the dispersion strengthened copper, the bonding of the nickel onto the DSC is enhanced, thus reducing problems resulting from nickel migration during lamp operation which results in filament brittleness.

In U.S. Pat. No. 4,415,830 it is suggested that iron alloys or steel are also suitable lead wire materials when containing a high silicon content, between 2 wt. % and 4.5 wt. %, well in excess of normal trace amounts of silicon in iron alloys, and having a carbon content of between 0.01–0.02 %. This material is taught to avoid allotropic transformation of the alpha ferrite, body-centered cubic, crystalline phase at lamp operating temperatures. During this phase transformation, the microstructure of the iron alloy changes in response to temperature increases during lamp use. The wire returns to its original phase during non-use. The constant phase change in the lead wire eventually causes the filament clamp to loosen, causing lamp failure. The '830 patent avoids this problem by using high silicon content iron alloy or steel wire to control allotropic transformation. It is necessary to maintain the carbon content of the wire at a low level, about 0.01–0.02 wt. %, because at increased levels of carbon the amount of silicon necessary to counteract the phase transformation becomes unworkable. Copper plating is used in this reference to prevent iron contamination.

Another drawback of steel lead wires is their low electric and thermal conductivity. Because of this, the steel lead wires have larger diameters, on the order of 20 mils. Thick lead wires, however, can cause problems in manufacturing and sealing the lamp, as well as cause an increase in the expense of producing the lamp.

The foregoing technology, while presenting viable options, does not completely solve lead wire problems relating to high temperature processing integrity of the lead wires, or reduced manufacturing expense without a corresponding reduction in lamp performance. It has remained for the subject invention to disclose the use of steel wire having a thick copper cladding, as opposed to a sheath or plating, which generally refer to a thin coating, for use as lead wire in lamp applications.

SUMMARY OF THE INVENTION

In view of the foregoing, it is therefore an object of the present invention to provide an improved composite lead wire for electric lamps.

Another object of the present invention is to provide a copper-steel composite lead wire capable of withstanding stem press temperatures.

A further object of the present invention is to provide a copper-steel composite lead wire capable of withstanding lamp operation temperatures without experiencing damage by allotropic phase transformation.

Yet, another object of the present invention is to provide a copper-steel composite lead wire having a thick copper cladding, the wire exhibiting at least 30% IACS electrical conductivity.

The foregoing objects are achieved in the present invention wherein it has been found that a copper-steel composite comprising a thick copper cladding on a low carbon steel wire withstands lamp operating temperatures as well as press seal temperatures and, when used for the inner lead wires, minimizes cost without compromising the performance of the lamp.

BRIEF DESCRIPTION OF THE DRAWINGS

A more complete understanding of the present invention can be obtained by considering the following detailed description with the accompanying drawings, in which.

DESCRIPTION OF THE PREFERRED EMBODIMENTS

As known to those of skill in the art, lead wires generally comprise three segments of conductive material. Specifically, lead wires generally comprise an outer conductor (outer lead) connected to an inner conductor (inner lead) by a short length of dumet wire which is positioned in a stem of pressed glass to provide a seal between the inside and the outside of the glass envelope of the lamp. The upper portion of the stem is inserted into the glass envelope of the lamp. The portions of the lead wires extending upwardly from the stem constitute the inner lead wires, while the portions of the lead wires extending downwardly from the stem constitute the outer lead wires. As was stated, that portion of the lead wire within the stem is commonly known as dumet wire, which is a nickel-iron core wire that is coated with copper and then heat treated to controllably oxidize the copper surface. The subject invention comprises a copper-steel composite material, suitable for use as lead wire in incandescent lamps, specifically as inner lead wire. More particularly, the invention comprises an iron alloy or steel core wire having a copper cladding, this composite wire exhibiting 30% or greater IACS (International Annealed Copper Standard), which is a measure of electrical conductivity at 20° C.

As used herein, the terms "plating" and "sheath", and all variations thereof, refer to thin coatings, on the order of a small fraction of a diameter, as used in the art of lamp applications. Likewise, the term "cladding", and all variations thereof, refers to a thicker coating, on the order of 30% IACS and greater.

The following detailed description is directed to the subject copper-steel composite lead wire and its use in incandescent lamps, which is the preferred embodiment of the invention. This is not, however, intended to exclude the use of the subject copper-steel composite lead wire in other lamp arrangements requiring the use of a lead wire clamped to the filament thereof, for which the composite lead wire is equally well suited.

Figure 1:
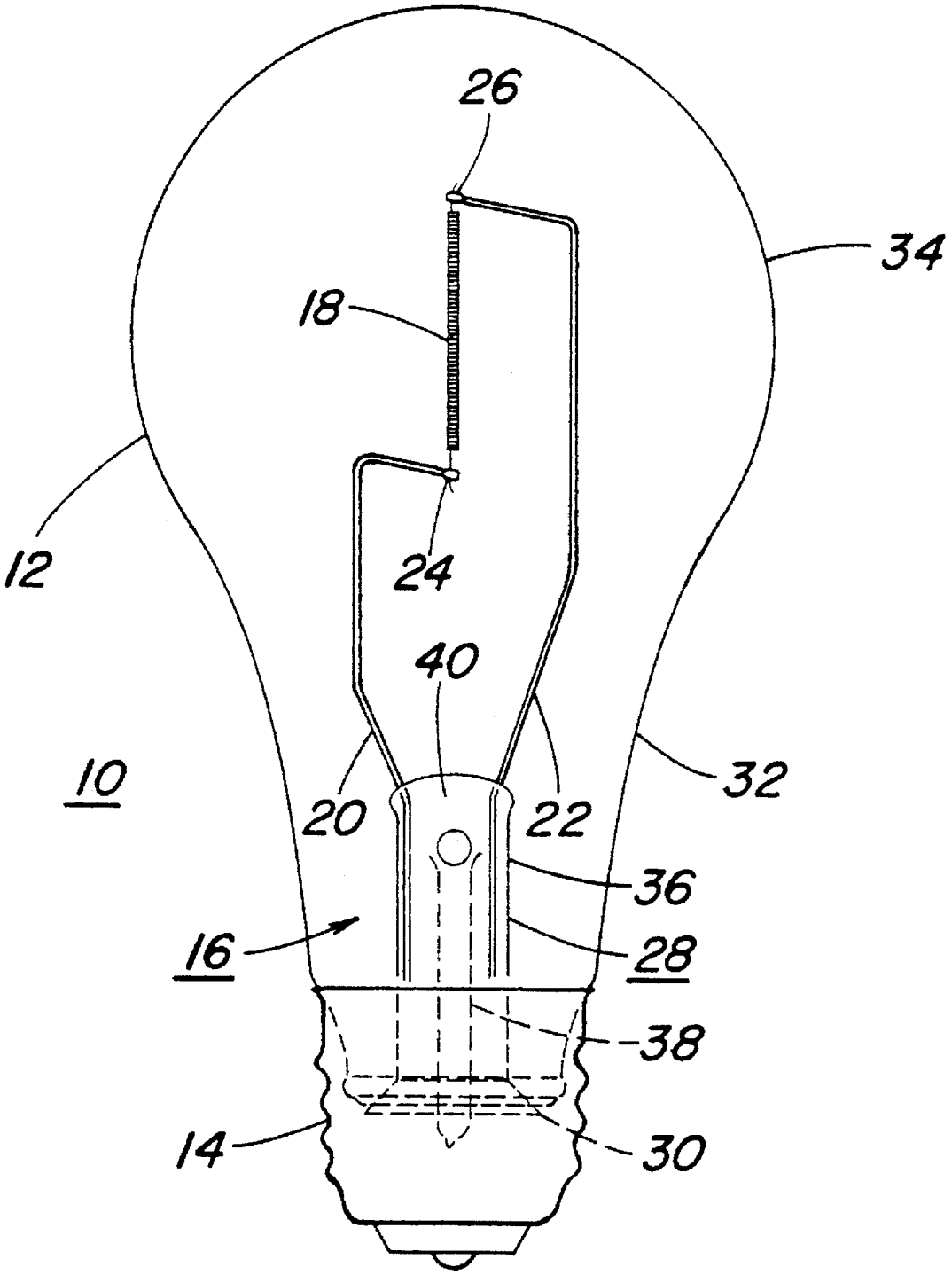
FIG. 1 illustrates a mount for an incandescent lamp in accordance with the present invention.

Now then, with particular reference to FIG. 1, there is shown in cross section an otherwise conventional incandescent lamp 10 having a transparent envelope 12 which is secured to a base member 14 to provide a housing assembly for mount construction 16 which supports the resistive incandescent filament 18 serving as the illumination source in said lamp. An inert gas or vacuum (not shown) is further provided within the sealed transparent envelope, which is conventionally made of glass, to protect against filament oxidation during lamp operation. The filament material is generally tungsten or some other suitable refractory metal, including alloys thereof. For the purpose of this invention, the term "transparent", being used to characterize the lamp envelope, signifies the ability to transmit visible light. Conventional incandescent lamps may further include coloration of the envelope material itself, as well as coatings on the lamp envelope of a material which diffuses or reflects light. Mount construction 16 provides longitudinal alignment of said filament coil 18 in the same direction as the longitudinal direction of a pair of in lead wires, 20 and 22 made in accord with the subject invention. Of course, the subject lead wires are equally well suited for use in known variations of this longitudinal alignment. Lead wires 20 and 22 are connected to each end 24 and 26, respectively, of the filament coil by clamping the lead wire around the filament. A central glass member 28 in the depicted mount construction is provided having a flare portion 30 which is sealed directly to a restricted neck portion 32 of the lamp glass envelope 12 at the base of a bulb portion 34 in said envelope. Said glass body member 28 is in the form of a hollow tube 36 which includes an inner gas exhaust tube 38. Said glass body member further includes a stem press 40 at the opposite end of said member having flare portion 30 to provide hermetic sealing of the inlead wires 20 and 22 in said lamp. As can be noted by an absence from said drawing, no other conventional tie wires or support wires are provided to physically support the lamp coil in said modified mount construction so that said pair of iron alloy in lead wires formed in accordance with the present invention provide the sole structural support for said lamp coil.

In accordance with the prior art for low wattage gas-filled incandescent lamps, the lead wires generally comprise nickel-plated copper or copper alloys. In accordance with the present invention, the inner and outer leads comprise a copper-steel composite wire. The composite wire comprises iron alloy, or steel, having a copper cladding. Copper-steel composite wire suitable for use as lead wires is available commercially from Torpedo Wire, and may be purchased with various conductivities. A similar material is available from Texas Instruments as well. While these commercially available products have been sold for various electrical applications, they have heretofore not been used as inner lead wires in lamps.

Copper-steel composite wire may be used for the inner lead wires of a lamp at a diameter of 6–20 mils, having at least 10% of the total diameter comprising the copper cladding on the wire. A 10% diameter copper cladding corresponds to about 30% IACS. As known by those of skill in the art, the outer surface of the inner lead wires may further comprise a thin nickel plating to minimize contamination within the lamp due to the release of contaminants from the surface of the copper during lamp operation.

The copper-steel wire composite of the subject invention comprises material having a conductivity in excess of 30% IACS. The copper cladding functions to conduct heat away from the filament clamp. Consequently, the use of a wire exhibiting high conductivity, i.e. thick copper cladding, and improved resistance to softening, affords the use of a smaller diameter wire than generally necessary when using steel or copper, making lamp manufacture easier, less costly and more efficient.

The copper-steel composite lead wires demonstrate excellent resistance to annealing during lamp processing and lamp operation, thus retaining the original strength of the material for use during lamp operation, thereby enhancing the performance of the lamp. This is primarily a function of the steel core of the wire which resists bending even after exposure to high temperatures, on the order of 700° C.

Further, the copper cladding due to its softer, malleable nature aids in the wire crimping easily and tightly to the lamp filament without causing the filament to fracture. The lead wire composite is therefore also readily formable so that leads are easily shaped to the desired mount configuration.

More importantly, the copper-steel composite wire exhibits a high temperature strength retention capability which enables the glass-to-metal sealing operation portion of the lamp manufacture to be performed at high temperatures without causing undue softening of the lead wires. This strength characteristic affords a reduction in lead wire diameter. For example, in a typical incandescent lamp assembly, operating at 100 watts, lead wire diameter of from 0.020 inches, common in steel lead wires, and 0.016 inches, common in copper lead wires, is reduced to a range of from about 0.010 to about 0.012 inches in the case of the subject copper-steel composite wire.

When using steel wire it is necessary to use thicker wire (0.020 inches) in order to achieve the required conductivity. With copper, the increased thickness of the wire (0.016 inches) is necessary to achieve the needed strength in the lead wire. The subject thinner wire exhibits the needed strength and conductivity, without increasing the diameter of the wire, by combining the strength of the steel and the conductivity of the thick copper cladding in a smaller diameter wire. Of course, the skilled artisan will appreciate that the diameter of the lead wire is a function of conductivity and voltage, and therefore the diameter of the subject lead wire will vary with intended use parameters. Nonetheless, the subject lead wire affords the user the capability to generally employ a smaller diameter lead wire. Of course, a practical limit to the minimum diameter of the lead wire is determined by the lamp operating temperature, i.e. a lead wire with too small a diameter may melt under certain operating and testing conditions.

The preferred lead wire of the invention is an unplated, copper clad steel wire exhibiting 70% IACS conductivity and having a steel core comprising AISI (American Iron and Steel Institute) 1006 steel having a diameter of about 0.007 inches. As was stated herein above, the steel core provides mechanical strength and resistance to annealing under high manufacturing and operating temperatures. The thick copper cladding contributes to the electrical conductivity of the wire, the ease of manufacturing, i.e. it readily forms the clamp on the filament, and copper does not by nature alloy with a tungsten filament during operation or manufacture as iron or steel may. Of course, while the foregoing AISI 1006 steel is herein preferred, the skilled artisan will be aware of other metals or alloys having similar strength and conductivity properties which will achieve the same results and may therefore readily be substituted in the subject invention. The preferred AISI 1006 steel generally contains the following elements at low levels:

| Element | % Composition |
|---|---|
| Carbon | 0.08 maximum |
| Manganese | 0.25–0.40 |
| Sulfur | 0.050 maximum |
| Phosphorus | 0.040 maximum |

The thickness of the copper cladding may range from 30% to 80% IACS. Thickness of the cladding is also a function of the operating parameters of the lamp. The overall preferred outer wire diameter may range from about 0.006 inches to about 0.020 inches. Of course, the inner lead wires may further have a nickel plating which functions to reduce oxygen contamination in the lamp atmosphere.

Figure 2:
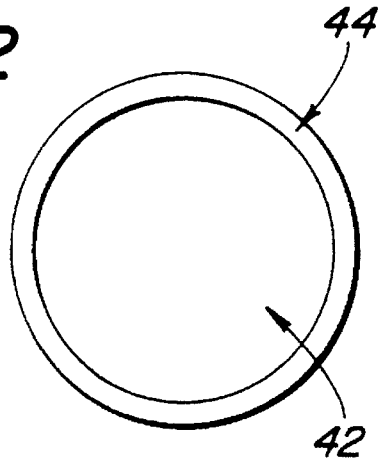
FIG. 2 represents a cross-sectional view of a prior art lead wire comprising 20 mil steel wire having a 2% protective nickel plating.
Figure 3:
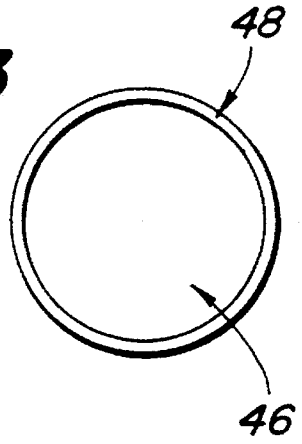
FIG. 3 represents a cross-sectional view of a prior art lead wire comprising a 12 mil DSC wire having a 7% copper plating.
Figure 4:
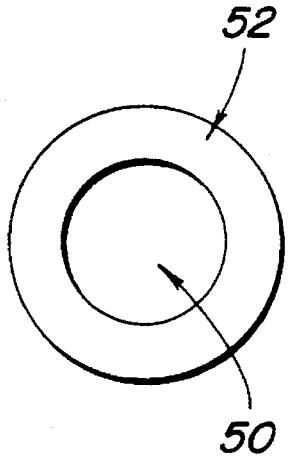
FIG. 4 represents a cross-sectional view of a 12 mil composite lead wire in accordance with the subject invention.

FIG. 2 represents a cross-sectional view of a prior art lead wire comprising a steel lead wire 42 having a 20 mil diameter. The steel lead wire further comprises a 2% nickel plate 44 which functions to reduce contamination within the lamp envelope. FIG. 3, also a cross-sectional view of a prior art lead wire, represents a 12 mil diameter DSC wire, having a dispersion strengthened copper core 46 bearing a 7% copper plating 48. FIG. 4 represents a cross-sectional view of the subject copper-steel composite lead wire having 12 mil diameter wherein a steel core 50 is clad with a thick coating of copper 52. Comparison of these FIGS. 2–4 graphically depicts the manner in which the subject invention achieves strength and electrical conductivity in a small diameter lead wire, as discussed hereinabove. Specifically, the FIG. 4 wire shows a much thicker copper coating than the prior art wires shown in FIGS. 2 and 3, without increasing the outer diameter of the wire.

As a further means of illustrating the conductivity as a function of copper cladding thickness, the following Table 1 sets forth various copper-steel composite lead wires consistent with the subject invention.

TABLE I

| EXAMPLE | OUTER DIAMETER* | CORE DIAMETER* | IACS | % Cu DIAMETER |
|---|---|---|---|---|
| 1a | 0.0100 | 0.0088 | 30% | 11.5% |
| 1b | 0.0126 | 0.0112 | 30% | 11.5% |
| 2a | 0.0100 | 0.0081 | 40% | 19.6% |
| 2b | 0.0126 | 0.0101 | 40% | 19.6% |
| 3a | 0.0100 | 0.0062 | 60% | 37.4% |
| 3b | 0.0126 | 0.0079 | 60% | 37.4% |

TABLE I-continued

| EXAMPLE | OUTER DIAMETER* | CORE DIAMETER* | IACS | % Cu DIAMETER |
|---|---|---|---|---|
| 4a | 0.0100 | 0.0058 | 70% | 41.8% |
| 4b | 0.0126 | 0.0073 | 70% | 41.8% |

*diameter measured in inches

The measurements presented in Table I represent manufacturer specifications for wires meeting the stated conductivity (IACS). Those examples labelled "a" are 0.0100 inch diameter wire and those labeled "b" correspond to 0.0126 inch diameter wire.

Having thus described the invention, it will be apparent to those of skill in the art that various modifications can be made within the spirit and scope of the present invention. For example, while described in a preferred embodiment as an inner lead for a standard incandescent lamp, the lead wire in accordance with the present invention may also be utilized in conjunction with miniature, fluorescent, high intensity, high wattage incandescent lamps, and other lamp arrangements requiring the use of a lead wire clamped to the lamp filament.

The embodiments of the invention in which an exclusive property or privilege is claimed are defined as follows:

1. An incandescent lamp having a mount comprising a refractory filament clamped one end thereof to each of a pair of lead wires at least a portion of said lead wires comprising a copper clad steel wire which exhibits an electrical conductivity of at least 30% IACS and wherein the copper cladding is at least 10% of the diameter of the wire.

2. The incandescent lamp as set forth in claim 1 wherein the copper clad steel portion of said lead wire is an inner lead wire.

3. The incandescent lamp as set forth in claim 2 wherein said inner lead wire is nickel plated.

4. A mount for an electric lamp comprising a flare having an exhaust tube and at least two lead wires inserted in said flare, said flare being pressed closed at one end thereof around said exhaust tube and lead wires, and at least one refractory metal filament connected to one end of each of said lead wires, at least a portion of said lead wires comprising copper clad steel wires which exhibit at least 30% IACS and wherein the copper cladding is at least 10% of the diameter of the wire.

5. The mount as set forth in claim 4 wherein said lead wires comprise inner and outer portions, said inner portion comprising said copper clad steel wires.

6. The mount as set forth in claim 5 wherein said inner portion of said lead wires are nickel plated.

7. An electric lamp comprising a transparent envelope which contains a resistive filament electrically connected to a pair of conductive lead wires, said lead wires comprising copper clad steel wires exhibiting an electrical conductivity of at least 30% IACS and wherein the copper cladding is at least 10% of the diameter of the wire.

8. The electric lamp as set forth in claim 7 wherein said copper clad steel wires comprises a steel core bearing a thick copper cladding.

9. The electric lamp as set forth in claim 7 wherein said lead wires have an outer diameter of from about 6 mils to about 20 mils.

10. The electric lamp as set forth in claim 7 wherein said lead wires have a nickel plating.

* * * * *